United States Patent [19]

Hodges et al.

[11] 4,398,071

[45] Aug. 9, 1983

[54] SNAP-ACTION SWITCH

[75] Inventors: Robert J. Hodges, Cheshunt; Aubrey M. Crick, Epping; Charles E. Rogers, Bishop's Stortford, all of England

[73] Assignee: ITT Industries, Inc., New York, N.Y.

[21] Appl. No.: 363,633

[22] Filed: Mar. 30, 1982

[30] Foreign Application Priority Data

Mar. 31, 1981 [GB] United Kingdom ..... 8110085

[51] Int. Cl.[3] ..... H01H 21/44

[52] U.S. Cl. ..... 200/67 DB; 200/339

[58] Field of Search ..... 200/67 DB, 67 DA, 339

[56] References Cited

U.S. PATENT DOCUMENTS 1,215,665 2/1917 Landis ..... 200/67 DB 4,336,429 6/1982 Jackson et al. ..... 200/67 DB

FOREIGN PATENT DOCUMENTS 104832 9/1938 Australia ..... 200/67 DB 649613 8/1937 Fed. Rep. of Germany ..... 200/67 DB 1223309 11/1962 France ..... 200/67 DB 796939 1/1981 U.S.S.R. ..... 200/67 D

*Primary Examiner*—John W. Shepperd

*Assistant Examiner*—Renee S. Kidorf

*Attorney, Agent, or Firm*—James B. Raden; William J. Michals

[57] ABSTRACT

An electrical snap-action switch has as its moving member a strip (15) of a springy metal with which there is integrally formed a contact-carrying arm (18). This strip is held bowed into a C shape in a metal carrier (10) with a concave inner face (11) near which the strip lies when in one position.

The operating member of the switch is a rocker (23) of an insulating material which rocks on a convex "bump" (24) on the carrier so that it has an inwardly extending pillar (24) with two studs one on each side of the strip (15). Hence operation of the rocker snaps the strip between its two positions, with corresponding movement of the contact carrying arm.

4 Claims, 6 Drawing Figures

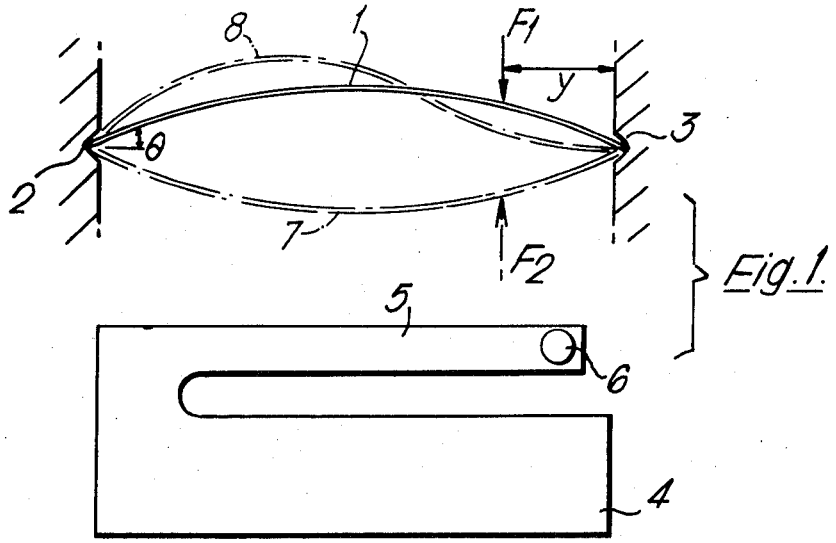
Fig. 1.
Fig. 2.
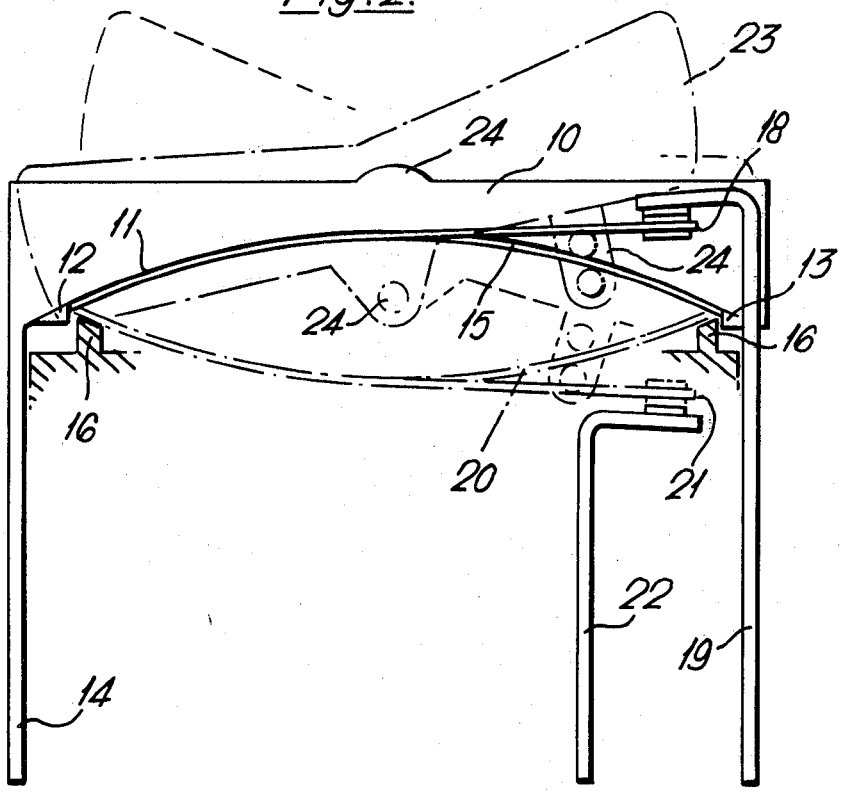

SNAP-ACTION SWITCH

This invention relates to electrical snap-action switches, especially for use in automotive, industrial and consumer products.

For such applications, switches are needed which are cheap and easy to manufacture, and which are rapid and positive in operation. One switch design to meet the needs for such applications has been described in U.S. Pat. No. 4,336,429.

The above-mentioned application describes, inter alia, a switch using as its movable element a strip of a springy metallic material so mounted in a frame that the strip is bowed. A transvere rod across the strip at its centre so constrains the strip that one half of it is bowed away from a flat surface while the other half is adjacent to and substantially parallel to the flat surface.

On the opposite side of the spring strip to the flat surface there is a rocker depression of which flips the spring strip between two stable states. Integral with the strip there is at least one contact-bearing tongue which extends parallel to the bowed strip and which is movable therewith when the bowed strip moves in snap-action manner in response to depression of the rocker. The contacts of the tongue co-operate with stationary contacts.

This invention has for its object the provision of a switch which is similar to that of the above-mentioned application in that its bowed strip is integral with a contact-carrying tongue, but in which a simpler arrangement of the strip and the rocker is used.

According to the invention, there is provided an electrical snap-action switch, which includes a strip of a springy metal held captive in a metal carrier member, the strip being so mounted that it is bowed and can assume either a first or a second stable position, wherein a contact-carrying arm integral with the bowed strip extends generally parallel thereto from one end of the bowed strip towards the other end thereof, so that when the strip is snapped between its said positions the arm is switched from its first position to its second position, the arm's contact means engaging stationary contact means in at least one of its said positions, wherein the carrier member has a concavely curved inner face close to which the bowed strip lies in its first position, wherein the carrier member is in electrical contact with an external terminal of the switch and also with said one end of the bowed strip and thus with the contact carrying arm, and wherein a switch actuating member engages the bowed strip at a position between its mid-point and its said other end, the operation of the actuating member snapping the bowed strip between its said positions and thus switching the contact-carrying arm between its two positions.

An embodiment of the present invention will now be described with reference to the accompanying drawings, in which:

FIG. 1 is a diagram explaining the operation of a snap-action switch using a C-configuration for its bowed strip.

FIG. 2 is a simplified diagram explanatory of the principles of the present invention.

Figure 3:
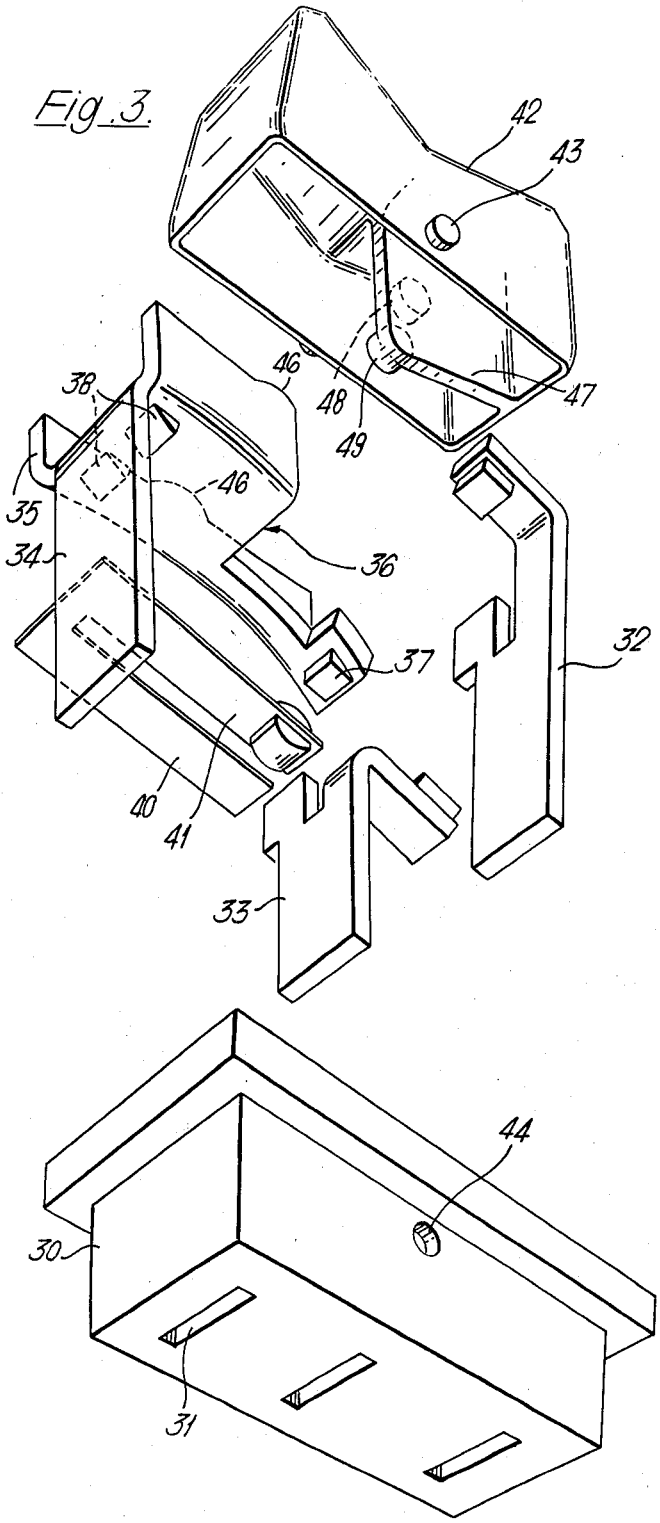
FIG. 3 is an exploded view of the components of a snap-action switch embodying the present invention.

We refer first to FIG. 1 in which the switch element is a bowed strip 1 of a springy metal, e.g. phosphor bronze or certain stainless steels, which is held at its ends in notches 2,3 in frame members of the switch. As can be seen from the lower part of FIG. 1, the switch element has two portions 4 and 5. Of these the portion 4 is the bowed portion while the portion 5 is a cantilever arm with contacts 6 at its end. When the portion 4 is snapped between its two positions by a force applied at $F_1$, the bowed strip snaps over to its other position 7 as shown dashed. During this changeover it passes through a condition indicated at 8, which means that the contact force actually increases at the start of the switching action, and that the contact break at a point at which the actuating force is decreasing and approaching zero. Resetting is effected by a force $F_2$. On each changeover the arm 5 is switched and it has a relatively large travel, while also having good contact pressure between the movable and the stationary contacts.

The actuating force thus acts on either side of the bowed strip, and the switching action is symmetrical about a line joining the strip's pivot points. The distance y between the pivot point 3 and the point at which the actuating force $F_1$ or $F_2$ acts is such as to give a positive snap action of the switch, and tease free operation of the contacts. For best results we have found that the distance y should be about one quarter of the length of the strip.

The actuating force depends on the difference between the strip length and the distance between the strip supports. If the strip is supported by plastics material the dimensions are subject to variation which has a detrimental effect on switch operation. To overcome this the arrangement of FIG. 2 is used.

In FIG. 2, there is a metal contact carrier 10, which may be of hard brass, which has a curved inner surface 11. Near its ends there are two tabs 12, 13, which are semi-sheared from the carrier. At one end of the carrier there is a flat strip 14, which is the common contact of the switch. The bowed strip 15 is held in place by the tabs 12, 13, and two plastic strip retainers 16, 16. In one state of the switch the bowed strip rests near the curved inner surface 11 of the carrier 10, in which case the contact carried by the cantilever arm is in the position shown at 18, in which case it engages a contact on the bent-over end of a fixed contact strip 19. In its other state the strip 15 is in the position shown as broken lines at 20, in which case the cantilever arm's contact is as shown at 21, where it engages a contact on the bent over end of another fixed contact strip 22. Thus the switch is a bistable changeover.

Switching is effected by a rocker 23, pivotted approximately at the point 24, which is of a plastics material. This rocker rides on a convex bump 24 on the carrier 10, so that it has a rolling movement as well as a rocking movement. The rocker 23 has a downwardly extending pillar 24, with two studs on it, one of which fits on each side of the strip 15. Hence movement of the rocker 23 between its two positions, via the pillar 24, switches the switch.

The use of a metallic carrier for the bowed strip eliminates the difficulties experienced if one supports the strip in plastics material, e.g. instability, poor wear characteristics and susceptibility to water. In addition a low resistance contact is achieved between the contact strip and the common output contact, using a small number of piece parts. The metal carrier is made by blanking and then forming sheet brass, which gives a rigid and stable frame with semi-sheared tabs to accurately locate the ends of the bowed strip. When the switch is assembled the plastics strips ensure that the bowed strip does not spring out of the tabs. Although it is not apparent from FIG. 2, part of the metal carrier is cut away to allow the cantilever arm to move between its extreme positions.

Figure 4:
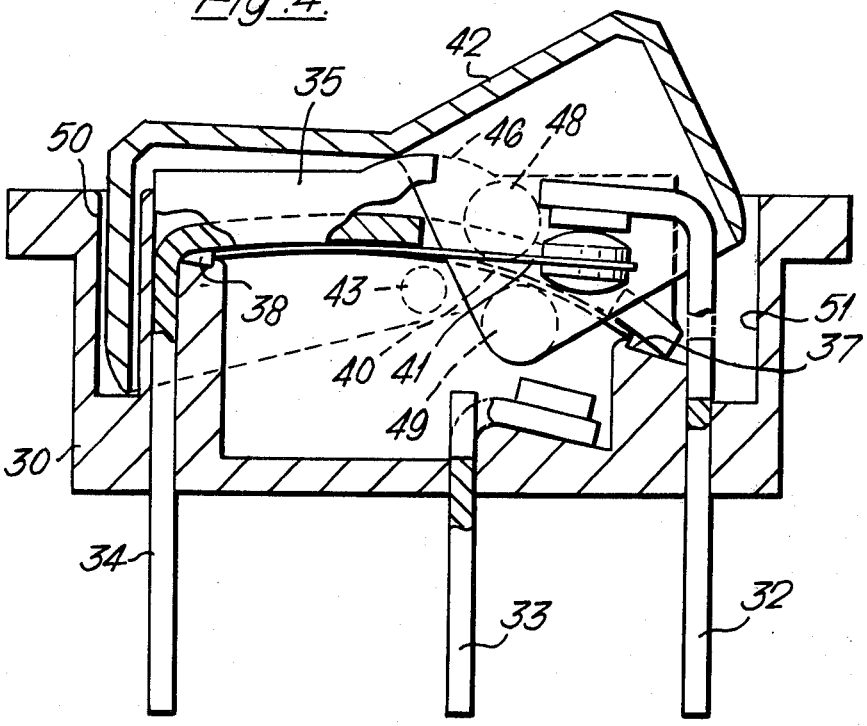
FIG. 4 is a part-sectional view of the switch of FIG. 3, shown inverted as compared with the representation of FIG. 3.
Figure 5:
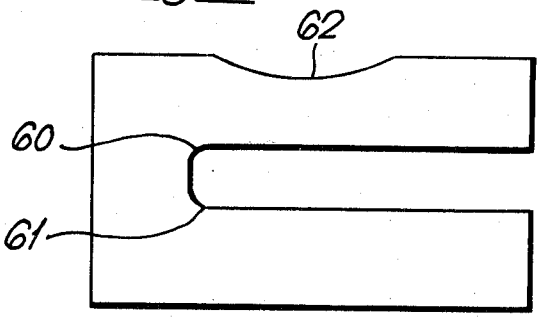
FIG. 5 is a plan view of a preferred shape for the strip/contact tongue used in a switch that as that of FIGS. 3 and 4.

The whole assembly is located in a moulded plastic body, which accurately locates the various parts, as will be seen from FIGS. 3 and 4, of which FIG. 3 is an "exploded" view of the switch, shown inverted as compared with the sectional view of FIG. 4. FIGS. 3 and 4 differ from the diagramatic views set forth in FIGS. 1 and 2 and, accordingly, different reference numerals are utilized to identify the respective elements.

In FIG. 3, the moulded body is shown at 30, and it has three slots such as 31 to receive the three contacts 32, 33 and 34, of which 34 is integral with the metal carriers 35. This carrier is of U cross-section, with a portion cut away at 36, as mentioned above, to allow movement of the movable contact arms. The tabs for locating the bowed strip are shown at 37, 38.

The bowed strip 40, which is located by the tabs 37, 38, is integral with the cantilever arm 41 which, as shown, carries contacts of a suitable, e.g. precious, metal for co-operation with similar contacts (not shown) on the inner bent-over surfaces of the contacts 32, 33.

At the top of FIG. 3, the switch-operating rocker 42 is shown: this is a plastics moulding, and is hollow. It has pins such as 43 on its two sides, which fit, rather loosely, in holes such as 44 on the switch body 30. The edges of the rocker 42 engage the convex bump 46 on the metal carrier to give a good wear-resistant connection. Inside the rocker 42 there is a rib 47 which carries two pins only one of which, 48, is visible in FIG. 3. These two pins fit one on each side of the bowed strip 40, and serve to switch it between its two positions when the rocker is operated.

The manner in which the parts of the switch are assembled will be apparent from FIG. 4, where the second pin 49, adjacent to pin 48, is also shown. The ends of the rocker fit into recesses 50, 51, in the body 30.

The effects of wear and fatigue on the bowed strip plus its cantilever arm can be minimised by suitable shaping, as shown in 55, where the inner corners 60, 61 are radiussed. In one case where the strip is 15 mm long by 8.5 mm wide, the radii of the corners 60, 61 were 0.5 mm and 1.0 mm, the larger one being on the cantilever arm. The bowed strip has a shallow cut-out 62 on its outer edge, and thus had a radius of 9.9 mm. This strip is of 0.15 mm thick beryllium-coppr alloy.

Figure 6:
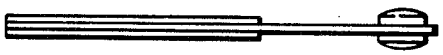
FIG. 6 is an edge-on view of another form of contact tongue/strip usable in a switch embodying the invention.

In certain cases the bowed strip/cantilever arm can be of composite construction, see the edge-on view in FIG. 6. Here the strip is of beryllium copper faced with stainless steel or a carbon steel to improve switching characteristics. The cantilever arm, as shown, is only of beryllium copper, and carries nickel-silver contacts.

In the arrangements described above the bowed strip is located on the metallic carrier by tabs semi-sheered therefrom. However, other means to locate the ends of the strip could be adopted.

We claim:

1. An electrical snap-action switch, which includes a strip of a springy metal held captive in a metal carrier member, the strip being so mounted that it is bowed and can assume either a first or a second stable position, wherein a contact-carrying arm integral with the bowed strip extends generally parallel thereto from one end of the bowed strip towards the other end thereof, so that when the strip is snapped between its said positions the arm is switched from its first position to its second position, the arm's contact means engaging stationary contact means in at least one of its said positions, wherein the carrier member has a concavely curved inner face close to which the bowed strip lies in its first position, wherein the carrier member is in electrical contact with an external terminal of the switch and also with said one end of the bowed strip and thus with the contact carrying arm, and wherein a switch actuating member engages the bowed strip at a position between its mid-point and its said other end, the operation of the actuating member snapping the bowed strip between its said position and thus switching the contact-carrying arm between its two positions.

2. A switch as claimed in claim 1, wherein the metal carrier member has a generally flat outer face with a convex-formed region between its ends, and wherein the actuating member is a rocker pivotally mounted over the convex-formed region so that the latter provides a rolling pivot therefor.

3. A switch as claimed in claim 2, wherein the rocker acts on the bowed strip by a pillar on the rocker which carries two generally cylindrical portions near its end, the two cylindrical portions fitting one on each side of the bowed strip.

4. A switch as claimed in claim 1, 2 or 3, wherein the ends of the bowed strip are located by tabs struck from the concave face of the carrier, and whe the strip is retained in place by plastic strips mounted adjacent to the carrier.

* * * * *